United States Patent [19]

Travis

[11] 4,066,032

[45] Jan. 3, 1978

[54] ELECTRICALLY POWERED OUTBOARD MOTOR MEANS

[76] Inventor: Calvin C. Travis, 1735 Coleen Road, Memphis, Tenn. 38111

[21] Appl. No.: 750,258

[22] Filed: Dec. 13, 1976

[51] Int. Cl.[2] ..... B63H 21/26

[52] U.S. Cl. ..... 115/18 E; 115/18 R

[58] Field of Search ..... 115/17, 18 R, 18 E; 114/144 R, 153, 144 RE

[56] References Cited

U.S. PATENT DOCUMENTS

| | | | |
|---|---|---|---|
| 2,079,871 | 5/1937 | Price | 115/18 E |
| 2,919,392 | 12/1959 | Smith | 115/18 E |
| 3,980,039 | 9/1976 | Henning | 115/18 E |

*Primary Examiner*—Trygve M. Blix
*Assistant Examiner*—D. W. Keen
*Attorney, Agent, or Firm*—John R. Walker, III

[57] ABSTRACT

An electrically powered outboard motor having a water submergible electric drive member, a shaft member fixedly attached to the drive member, an attachment member for movably attaching the shaft member to a boat, and an electric circuit for allowing electrical power to selectively pass from an electric storage battery to the drive member. The electric circuit is adapted to allow the drive member to be turned so as to control the direction of the boat without causing the electrical conductor wires which allow electric power to pass from the electric storage battery to the drive member to turn with the drive member. Additionally, the electric circuit is adapted to allow the drive member to be raised or lowered relative to the attachment member without breaking the electrical contact between the electric storage battery and the drive member.

10 Claims, 5 Drawing Figures

11
72
70
75
55
57
45
43
77
59
82
81
23
80
21
17
37
39
13
15'
35
27'
35'
31
15
29
19
33

11
72
70
75
35"
77
57
55
59
V
82
81
45
43
23
80
V
21
17
37
39
13
35
15'
27'
35'
31
29
19
15
33

41
25
77
77'
CONNECTOR MEANS
80
69
67
13
71
79
M
27

11
72
70
73
75
71
77"
69
79
35"
83
21
35
77
55
57
82
63
65
59
61
78
77'
53'
53
45
49
41
47
43
51
80
27'
35'
31
27
29
33
19

53'
53
49
41
45
47
43
51
81
21
35

ELECTRICALLY POWERED OUTBOARD MOTOR MEANS

BACKGROUND OF THE INVENTION

1. Field of the Invention

This invention relates generally to outboard motors for use with boats and more specifically to such outboard motors that are electrically powered.

2. Description of the Prior Art

Electrically powered outboard motors are commonly used to cause boats to move upon a body of water. Various types of such outboard motors have heretofore been developed. The following U.S. patents disclose such electrically powered outboard motor means that allow the direction of the boat to be remotely controlled as by the feet of the user thereof: Buchet, U.S. Pat. No. 1,887,540; Harris, U.S. Pat. No. 2,877,733; Scivally, U.S. Pat. No. 3,052,204; and Fortson, U.S. Pat. No. 3,580,212. The above patents, taken as a whole, do not disclose, teach or suggest the present invention. While these outbroad motor means are useful, many persons prefer to control the outboard motor by hand to thus have direct hand control over the maneuverability of the outboard motor rather than having indirect control by way of foot operated pedals or the like.

One prevalent problem with the majority of present electrically powered outboard motor means which are controlled directly by hand is the fact that when the drive means of the outboard motor is turned to maneuver the boat, the electrical wires between the electrical storage battery and the drive means limits the amount of rotation of the drive means and often tangles up and winds about portions of the outboard motor means. Price, U.S. Pat. No. 2,079,871, discloses an electrically powered outboard motor which is controllable directly by hand and which overcomes the above-mentioned problem by attaching the wires coming from the electric storage battery to a metal ring which is rotatably mounted about a portion of the outboard motor which rotates with the drive means so that the drive means can be rotated without causing the wires from the electric storage battery to likewise rotate. A second metal ring is fixedly mounted to the portion of the outboard motor that rotates with the drive means in contact with the first metal ring so that electric power can be transferred therethrough. Electric power is then transferred from the second metal ring to the drive means. The major problem with the device disclosed by Price is that when it is necessary to adjust the depth of the drive means in the water by raising the drive means relative to the boat, the electrical contact between the first and second metal rings will be broken.

SUMMARY OF THE INVENTION

The present invention is directed towards overcoming the problems and disadvantages of prior electrically powered outboard motor means. The concept of the present invention is to provide an electrically powered outboard motor means which does not require the electrically conductive wires connecting the outboard motor means to a source of electrical power to rotate with the drive means when the drive means is rotated to maneuver the boat and which does not require the electrical contact between the source of electrical power and the drive means to be broken when the drive means is raised or lowered relative to the boat onto which the outboard motor means is mounted.

The outboard motor means of the present invention includes, in general, drive means having a water submergible electric motor and a propeller member rotatably driven by the electric motor; shaft means having first and second ends with the first end fixedly attached to the electric motor of the drive means; attachment means for movably attaching the shaft means to the boat with the drive means positioned beneath the surface of the body of water; and circuit means for selectively allowing electric power to pass from the source of electrical power to the electric motor of the drive means. The circuit means includes a first conductor member movably attached to the shaft means and selectively electrically attachable to the source of electrical power and includes a second conductor member substantially nonrotatably attached to the shaft means and electrically attached to the electric motor of the drive means for allowing electric power to pass from the source of electrical power to the electric motor when the first and second conductor members are contacting one another. The second conductor member is movable relative to the shaft means so that the second conductor member can remain in electrical contact with the first conductor member even when the shaft means is raised relative to the first conductor member.

DESCRIPTION OF THE PREFERRED EMBODIMENT

Figure 1:
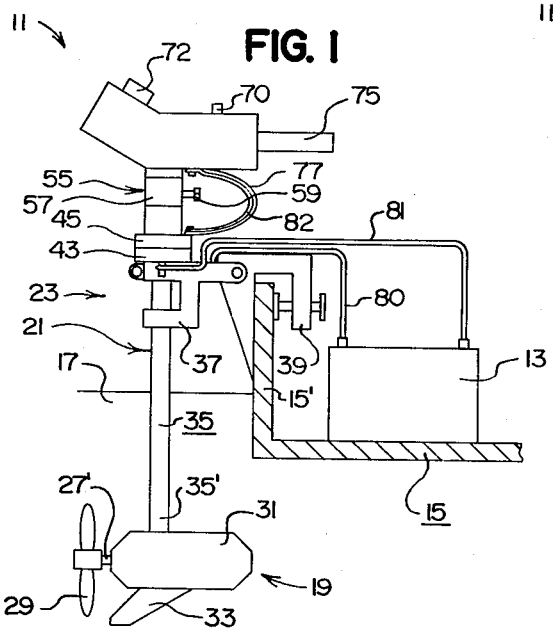
FIG. 1 is a side elevational view of the outboard motor means of the present invention shown attached to a boat and electrically attached to an electric storage battery.
Figure 2:
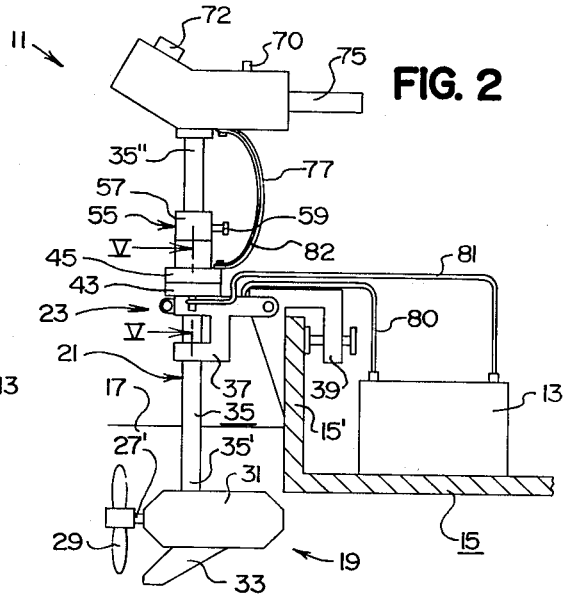
FIG. 2 is a side elevational view of the outboard motor means of the present invention similar to FIG. 1 but showing the outboard motor means in a moved position.
Figure 3:
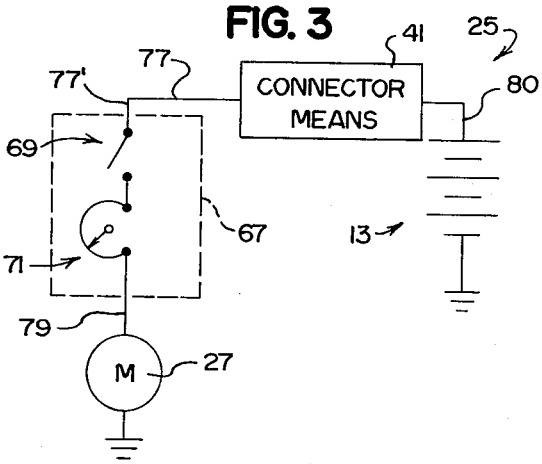
FIG. 3 is a schematic diagram showing the electrical components of the outboard motor means of the present invention attached to an electric storage battery.

The outboard motor means 11 of the present invention is of the type for attachment to a source of electrical power such as a typical electric storage battery 13 and for attachment to a boat 15 to cause the boat 15 to move upon a body of water as at 17 (see FIGS. 1 and 2). The outboard motor means 11 includes, in general, a drive means 19, a shaft means 21 fixedly attached to the drive means 19, an attachment means 23 for movably attaching the shaft means 21 to the boat 15, and circuit means 25 (see FIG. 3) for selectively allowing electric power to pass from the electric storage battery 13 to the drive means 19.

The drive means 19 includes an electric motor 27 having a rotatable shaft 27' and includes a propeller member 29 fixedly attached to the rotatable shaft 27' of the electric motor 27 to thereby be rotatably driven by the electric motor 27. The drive means 19 may include a substantially watertight housing member 31 for enveloping the electric motor 27 so that the electric motor 27 may be submerged into the body of water 17. A rudder 33 or the like is preferably secured to the housing member 31 for reasons well known to those skilled in the art.

The shaft means 21 may consist of a hollow pipelike member 35 having a first end 35' fixedly attached to the housing member 31 of the drive means 19 and having a second end 35". The first end 35' of the hollow pipelike member 35 may be fixedly attached to the housing member 35 of the drive means 19 in any number of ways which should be apparent to those skilled in the art such as by screw threads, welding or the like.

The attachment means 23 may consist of any well-known means commonly used for movably attaching an outboard motor to a boat. The attachment means 23 may include a first portion 37 for movable attachment to the shaft means 21 and may include a second portion 39 for substantially fixed attachment to the boat 15. The attachment means 23 may be adapted to attach the outboard motor means 11 to the transom 15' of the boat as shown in FIGS. 1 and 2 or may be adapted to attach the outboard motor means 11 to the bow or other place on the boat 15 in a manner well known to those skilled in the art. One such attachment means for allowing the outboard motor means 11 to be attached to the bow of the boat is the "Universal Bow Troll Bracket", Model No. 142, manufactured by Yoder Manufacturing Company, 1823 East 17th Street, Little Rock, Arkansas 72202.

The circuit means 25 preferably includes a connector means 41 comprises of a first conductor member 43 and a second conductor member 45. The first conductor member 43 is movably attached relative to the shaft means 21 so that the conductor means 43 may be held stationary and shaft means 21 rotated therein, and is selectively electrically attachable to the electric storage battery 13. The second conductor member 45 is preferably substantially nonrotatably attached to the shaft means 21 and is electrically attached to the electrical motor 27 of the drive means 19 for allowing electric power to pass from the electric storage battery 13 to the electric motor 27 when the first and second conductor members 43, 45 are contacting one another. The second conductor member 45 is movable relative to the shaft means 21, i.e., up and down relative to the shaft means 21, so that the second conductor member 45 can remain in electrical contact with the first conductor member 43 when the shaft means 21 is raised relative to the first conductor member 43.

Figure 4:
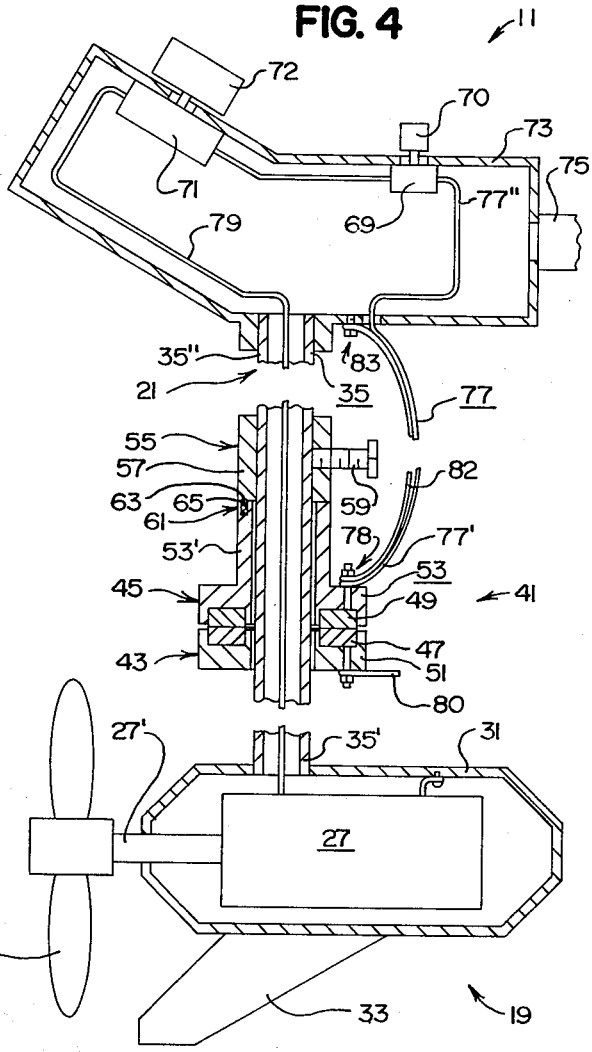
FIG. 4 is a sectional side elevational view of the outboard motor means of the present invention with some parts broken away for clarity.
Figure 5:
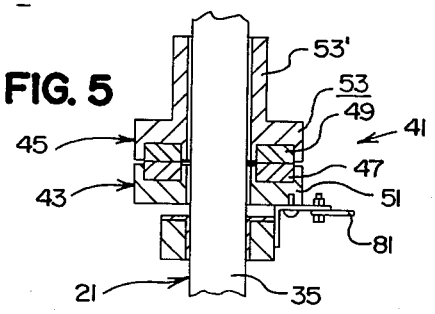
FIG. 5 is a sectional view of a portion of the outboard motor means of the present invention as taken on line V—V of FIG. 2 with some parts broken away and removed for clarity.

The first conductor member 43 preferably includes an electrically conductive ring member 47 for being positioned about the shaft means 21 (see FIGS. 4 and 5). The ring member 47 has an inside diameter of a size larger than the outside diameter of the shaft means 21 for allowing the ring member 47 to freely move relative to the shaft means 21 and to be in spaced relationship thereto. The second conductor member 45 preferably includes an electrically conductive ring member 49 for being positioned about the shaft means 21 (see FIGS. 4 and 5). The ring member 49 has an inside diameter of a size larger than the outside diameter of the shaft means 21 for allowing the ring member 49 to freely move relative the shaft means 21 and to be in spaced relationship thereto. Nonconductive body portions 51, 53 may be attached to the ring members 47, 49 respectively for electrically insulating the ring members 47, 49 from the shaft means 21 and the like. Each of the nonconductive body portions 51, 53 have an inside diameter of a size larger than the outside diameter of the shaft means 21 for allowing the body portions 51, 53 to respectively freely move relative to the shaft means 21. Also, the nonconductive body portion 53 may include a collar-like portion 53' for reasons which will hereinafter become apparent.

The second conductor member 45 may include means 55 for preventing rotation of the ring member 49 of the second conductor member 45 about the shaft means 21. The means 55 may include a collar type clamp 57 adapted to be selectively fixedly clamped to the shaft means 21 in a manner which should be apparent to those skilled in the art. For example, the collar type clamp 57 may include a screw 59 for being securely screwed against the shaft means 21 to secure the collar type clamp 57 thereto. The means 55 may also include ball and detent means 61 for coacting between the collar type clamp 57 and the collar-like portion 53' of the nonconductive body portion 53 to selectively prevent rotation of the ring member 49. The ball and detent means 61 may be constructed in any manner well known to those skilled in the art. For example, one or more detents 63 may be provided in the bottom of the collar type clamp 57 and one or more corresponding spring activated balls 65 may be provided in the top of the collar-like portion 53' of the nonconductive body portion 53 (see FIG. 3). It should be noted that the means 55 for preventing rotation of the ring member 49 relatively to the shaft means 21 may be constructed in various other manners apparent to those skilled in the art.

The circuit means 25 may include control means 67 interposed between the second conductor member 45 and the electric motor 27 of the drive means 19. The control means 67 may include a switch member 69 having a knob 70 or the like for allowing manual control of the passage of electric power from the electric storage battery 13 to the electric motor 27 of the drive means 19 by the user of the outboard motor means 11. The control means 67 may also include in series with switch 69, a variable resistor means 71 or the like having a knob 72 or the like for allowing the user of the outboard motor means 11 to control the amount of electric power passing to the electric motor 27 to thereby control the speed of the boat 15 upon the body of water 17. The control means 67 is preferably substantially fixedly attached to the second end 35' of the hollow pipelike member 35 of the shaft means 21. More specifically, the control means 67 may include a hollow housing member 73 fixedly attached to the second end 35" of the hollow pipelike member 35 in any manner apparent to those skilled in the art such as by screw threads or welding. The switch member 69 and variable resistor 71 are preferably fixedly attached to the housing member 73. A handle 75 may be provided on the housing member 73 to allow the user of the outboard motor means 11 to easily rotate the drive means 19 by rotating the shaft means 21.

The circuit means 25 preferably includes a flexible conductor member 77 having a first end 77' fixedly and electrically attached to the ring member 49 of the second conductor member 45 in any manner apparent to those skilled in the art such as by the screw 78 (see in, general, FIG. 4) and having a second end 77" fixedly and electrically attached to the control means 67 (see FIG. 3) for allowing the second conductor member 45 to move relative to the control means 67 while remaining in electrical contact therewith. Another length of electrically conductive wire 79 is preferably provided for electrically connecting the control means 67 and the electric motor 27 of the drive means 19. Likewise, a length of electrically conductive wire 80 is preferably provided for electrically connecting the electric storage battery 13 and the first conductor member 43. A length of electrically conductive wire 81 may also be provided for grounding the electric storage battery 13 to the outboard motor means 11 in any manner apparent to those skilled in the art.

The outboard motor means 11 may also include a spring means 82 for normally forcing the second conductor member 45 against the first conductor member 43 to make electrical contact therewith. The spring means 82 may be integral with the flexible conductor member 77 of the circuit means 25. For example, the spring means 82 may be fixedly attached at one end to the housing member 73 in any manner apparent to those skilled in the art such as by the screw 83 (see FIG. 4) and may be fixedly attached to the second conductor member 45 in any manner apparent to those skilled in the art such as by way of the screw 78 and the flexible conductor member 77 may be fixedly attached to the spring means 82 in any manner apparent to those skilled in the art such as by being enclosed with the spring means 82 in a flexible rubber sleeve (not shown) or the like to thereby make the spring means 82 and the flexible conductor member 77 substantially integral with one another.

It will be understood from the foregoing that regardless of the position of motor 31, that is, whether raised as in FIG. 2 or lowered as in FIG. 1, or in positions in between; the conductive ring members 47, 49 will remain in contact so that the motor 31 can be turned on at all times, if desired, even if in shallow water, and the shaft 35 can be turned. Thus, the boat 15 can be guided and driven regardless of the position of motor 31. Also, it will be understood that the above is true at all times and regardless of whether the clamp 57 is fixed relative to shaft 35 by tightening screw 59, as when the motor 31 is held in a raised position by clamp 57 such as shown in FIG. 2, or whether the clamp 57 is movable relative to shaft 35 by loosening screw 59, as to lower motor 31, or if the clamp 57 is movable and the motor 31 is raised and held upwardly temporarily by hand. Additionally, it will be understood that conductor member 43 is limited in downward movement by attachment means 23, and is supported thereby, so that conductor member 45 contacts conductor member 43 under the influence of spring means 82, or of gravity alone, if it is desired to omit spring 82 and the motor 19 is being held up by hand. If clamp 57 is fixed to shaft 35, it will be understood that the weight of motor 31, shaft 35, etc. is transmitted to conductor member 45 to hold it down against conductor member 43.

Although the invention has been described and illustrated with respect to a preferred embodiment thereof, it is not to be so limited since changes and modifications may be made therein which are within the full intended scope of the invention.

I claim:

1. An improved electrically powered outboard motor means of the type for causing a boat to move upon a body of water and having drive means including a water submersible electric motor and a propeller member rotatably driven by said electric motor, having shaft means fixedly attached to said electric motor of said drive means, having attached means for movably attaching said shaft means to the boat with said drive means positioned beneath the surface of the body of water, and having circuit means including a first conductor member movably mounted about said shaft means for selectively receiving electrical power from a source of electrical power and including a second conductor substantially nonrotatably mounted about said shaft means when said motor means is being used in a normal manner to cause a boat to move upon a body of water for selectively transferring electrical power from said first conductor member to said electric motor when said first and second conductor members are contacting one another, wherein the improvement comprises: movably attaching said second conductor member to said shaft means for allowing said second conductor member to remain in contact with said first conductor member when said shaft means is raised or lowered relative to said first conductor member.

2. An outboard motor means of the type for attachment to a source of electrical power and for attachment to a boat to cause the boat to move upon a body of water, said outboard motor means comprising:

a. drive means, said drive means including a water submersible electric motor and a propeller member rotatably driven by said electric motor;

b. shaft means having first and second ends with said first end fixedly attached to said drive means;

c. attachment means for movably attaching said shaft means to the boat with said drive means positioned beneath the surface of the body of water; and d. circuit means for selectively allowing electric power to pass from the source of electrical power to said electric motor of said drive means, said circuit means including a first conductor member movably mounted about said shaft means and selectively electrically attachable to the source of electrical power and including a second conductor member substantially nonrotatably mounted about said shaft means when said motor means is being used in a normal manner to cause a boat to move upon a body of water and electrically attached to said electric motor of said drive means for allowing electric power to pass from the source of electrical power to said electric motor when said first and second conductor members are contacting one another, said second conductor member being movable up and down relative to said shaft means for allowing said second conductor member to remain in electrical contact with said first conductor member when said shaft means is raised and lowered relative to said first conductor member.

3. The outboard motor means of claim 2 in which said circuit means includes control means interposed between said second conductor member and said electric motor of said drive means, said control means including a switch member for allowing manual control of the passage of electric power from the source of electrical power to said electric motor of said drive means by the user of said outboard motor means, said control means being substantially fixedly attached to said second end of said shaft means.

4. The outboard motor means of claim 3 in which said circuit means includes a flexible conductor member having a first end fixedly attached to said second conductor member and having a second end fixedly attached to said control means for allowing said second conductor member to move relative to said control means.

5. The outboard motor means of claim 4 in which is included spring means for normally forcing said second conductor member against said first conductor member.

6. The outboard motor means of claim 4 in which said first conductor member includes an electrically conductive ring member for being positioned about said shaft means, said ring member of said first conductor member having an inside diameter of a size larger than the outside diameter of said shaft means for allowing said ring member to freely move upon said shaft means, in which said second conductor member includes an electrically conductive ring member for being positioned about said shaft means, said ring member of said second conductor member having an inside diameter of a size larger than the outside diameter of said shaft means for allowing said ring member to freely move upon said shaft means, and in which said second conductor member includes means for preventing rotation of said ring member of said second conductor member about said shaft means.

7. The outboard motor means of claim 6 in which said first conductor member includes a nonconductive portion for electrically insulating said ring member of said first conductor member from said shaft means, and in which said second conductor member includes a nonconductive portion for electrically insulating said ring member of said second conductive member from said shaft means.

8. An outboard motor means of the type for attachment to an electric storage battery and for attachment to a boat to cause the boat to move upon a body of water, said outboard motor means comprising:

a. drive means including electric motor, including a propeller member rotatably driven by said electric motor, and including a substantially watertight housing member for enveloping said electric motor;

b. hollow shaft means having a normally downwardly directed first end and a normally upwardly directed second end, said first end of said shaft means being fixedly attached to said housing member of said drive means;

c. attachment means for movably attaching said shaft means to the boat with said drive means positioned beneath the surface of the body of water, said attachment means including a first portion for movable attachment to said shaft means and including a second portion for substantially fixed attachment to the boat; and d. circuit means for selectively electrically connecting said electric motor of said drive means to the electric storage battery to allow electric power to pass from the electric storage battery to said electric motor of said drive means, said circuit means including a first conductor member movably mounted about said shaft means and selectively electrically attachable to the electric storage battery, said first conductor member including an electrically conductive ring member for being positioned about said shaft means, said ring member of said first conductor having an inside diameter of a size larger than the outside diameter of said shaft means for allowing said ring member to freely move upon said shaft means, said circuit means including a second conductor member substantially nonrotatably mounted about said shaft means when said motor means is being used in a normal manner to cause a boat to move upon a body of water and electrically attached to said electric motor of said drive means, said second conductor member including an electrically conductive ring member for being positioned about said shaft means, said ring member of said second conductor member having an inside diameter of a size larger than the outside diameter of said shaft means for allowing said ring member to freely move up and down upon said shaft means, said second conductor member including means for substantially preventing rotation of said ring member of said second conductor member about said shaft means, said circuit means including control means interposed between said second conductor member and said electric motor of said drive means, said control means including a switch member for allowing manual control of the passage of electric power from the electric storage battery to said electric motor of said drive means by the user of said outboard motor means, said control means being substantially fixedly attached to said second end of said shaft means, said circuit means including a flexible conductor member having a first end fixedly attached to said ring member of said second conductor member and having a second end fixedly attached to said control means for allowing said second conductor member to move relative to said control means.

9. The outboard motor means of claim 8 in which is included spring means for normally forcing said second conductor member against said first conductor member.

10. The outboard motor means of claim 9 in which said spring means and said flexible conductor member of said circuit means are integral with one another.

* * * * *